US005994279A

United States Patent [19]

Felsky et al.

[11] Patent Number: 5,994,279

[45] Date of Patent: Nov. 30, 1999

[54] HIGH VISCOSITY, BIODEGRADABLE LUBRICATING OIL

[75] Inventors: Gerald Felsky; Chung-Lai Wong, both of Sarnia; Todd Timothy Nadasdi, Kingsville, all of Canada

[73] Assignee: Exxon Research and Engineering Company, Florham Park, N.J.

[21] Appl. No.: 09/232,447

[22] Filed: Jan. 15, 1999

[51] Int. Cl.[6] ..... C10M 129/72

[52] U.S. Cl. ..... 508/491; 508/496; 508/499; 508/505

[58] Field of Search ..... 585/11; 508/491, 508/505, 496, 499

[56] References Cited

U.S. PATENT DOCUMENTS 3,554,911 1/1971 Schiff ..... 585/11

5,681,800 10/1997 Duncan et al. ..... 508/485

FOREIGN PATENT DOCUMENTS 0 747 466 12/1996 European Pat. Off. .

*Primary Examiner*—Jacqueline V. Howard
*Assistant Examiner*—Cephia D. Toomer
*Attorney, Agent, or Firm*—Joseph J. Allocca

[57] ABSTRACT

A lubricant composition especially useful for saw guide use comprises a base oil composed of at least one synthetic ester and a thickener composed of a styrene-olefin copolymer dissolved in a vegetable oil. The thickener is present in an amount sufficient to provide the lubricant with a viscosity at 40° C. of greater than about 100 cSt.

9 Claims, No Drawings

HIGH VISCOSITY, BIODEGRADABLE LUBRICATING OIL

FIELD OF THE INVENTION

The present invention relates generally to high viscosity, biodegradable lubricating oils especially useful as sawguide lubricants.

BACKGROUND OF THE INVENTION

Relatively high viscosity lubricants have numerous commercial applications. For example, lubricants having a viscosity of about 110 cSt at 40° C. are used as sawguide lubricants in sawmills. Because the lubricants end up in the sawdust and ultimately in the environment, it is desirable that the lubricant be biodegradable. Thus lubricants based on rapeseed oil, which is biodegradable, are currently used as sawguide lubricants.

Rapeseed oil, however, does have certain disadvantages. For example, rapeseed oil has a relatively high pour point and a relatively low oxidation stability when compared with many other base oils. Also, the supply of rapeseed oil is uncertain.

Therefore, there is a need for biodegradable lubricants which have a relatively high viscosity and which are not based on rapeseed oil.

SUMMARY OF THE INVENTION

The lubricant composition of the present invention comprises a base oil composed of at least one synthetic ester oil and a thickener composed of a styrene copolymer dissolved in a vegetable oil, especially rapeseed or canola oil. The thickener is present in an amount sufficient to provide the lubricant composition with a viscosity at 40° C. of greater than about 100 cSt, and preferrably about 110 cSt to about 130 cSt. Optionally, but preferably, the composition includes one or more antiwear, extreme pressure and rust inhibitor additives and an emulsifier.

DETAILED DESCRIPTION OF THE INVENTION

The base oil of the present invention is composed of at least one synthetic ester oil although blends of synthetic ester oils may be used.

Useful synthetic esters include the esters of monocarboxylic and polycarboxylic acids with monohydroxy alcohols and polyols. Typical examples are didodecyl adipate, diisodecyladipate, trimethylolpropane tripelargonate, pentaerythritol tetracaproate, di(2-ethylhexyl) adipate, and dilauryl sebacate. Complex esters made from mixtures of mono- and dicarboxylic acids and mono-and/or polyhydric alkanols can also be used. Preferably, the base oil will be composed of diisodecyl adipate.

The base oil typically will have a viscosity at 40° C. in the range of about 2 to about 50 cSt.

The thickener used in the present invention is composed of a styrene-olefin copolymer dissolved in a vegetable oil, especially rapeseed or canola oil. Useful styrene-olefin copolymers include styrene-isoprene and styrene-butadiene copolymers having a number average molecular weight in the range of about 50,000 to about 500,000. Especially preferred is a styrene butadiene copolymer of number average molecular weight of from about 100,000 to about 150,000. The amount of copolymer dissolved in the rapeseed or canola oil is in the range of 10 to 90% by weight.

The thickener is used in an amount sufficient to provide a lubricating composition having a viscosity at 40° C. of greater than about 100 cSt and preferably about 110 cSt to 130 cSt. In general the thickener will be present in an amount ranging between about 0.1 to about 30 wt. % based on the total weight of base oil and thickener.

Optionally, but preferably, the lubricant composition will include an effective amount of one or more antiwear, extreme pressure and rust inhibitor additives. Examples of antiwear agents include sulfurized olefins, ester, fatty acids and the like, especially sulfurized isobutylene. Examples of extreme pressure agents include hydrocarbyl esters of phosphoric acids such as dibutyl hydrogen phosphate. Various anti-oxidants such as hindered alkyl amines and alkyl thiadiazoles are also includeable. Indeed, suitable and preferred additive packages include alkyl phosphoroic acid ester amine salts, dibutyl hydrogen phosphate, alkylated tallow amines, oleyamine, sulfurized isobutylene and alkyl thiadiazole. When used, the additives will comprise about 1 to about 5 wt. % of the total composition.

The composition may also include an effective amount of an emulsifier. Particularly preferred are borated compounds such as borated succinimide, borated alkyl and alkenyl succinimide and the like. Typically the emulsifier will be present in an amount ranging from about 0.1 to about 2 wt. % based on the total weight of the composition.

EXAMPLE

A lubricant composition was formulated by heating a synthetic ester base oil to about 65° C. Then a thickener comprising a styrene copolymer in vegetable oil, preheated to about 55° C. was added to the base oil with stirring. Finally an emulsfier and additive package was added. The amounts of the various ingredients and the properties of the resultant compositions are given in Table 1.

| COMPONENT | COMPOSITION | WT. % |
|---|---|---|
| Base Oil(1) | Linear diester | 74.2 |
| Thickener(2) | Styrene copolymers/vegetable oil | 23.4 |
| Emulsifier(3) | Boroated succinamide | 0.4 |
| Additives(4) | Dibutyl hydrogen phosphate, alkylated tallow amines, alkylthiadiazole, alkyl phosphoric acid amine salts | 2.0 |
| PROPERTIES | | |
| Viscosity @40° C. | | 105.9 |
| Viscosity @100° C. | | 23.98 |
| Density | | 0.9231 |
| Flash Point (° C.) | | 212 |
| Pour Pt. (ASTM D97) | | <-54° C. |

(1)Vistone A5-15 sold by Exxon Corp., Irving, Texas
(2)Functional Products 588 sold by Functional Products Inc., Cleveland, Ohio
(3)Mobilad C200 sold by Mobil Chemical Co., Edison, NJ
(4)Mobidad G251 sold by Mobil Chemical Co., Edison, NJ

What is claimed is:

1. A lubricant composition comprising:

a base oil of at least one synthetic ester oil; and a thickener composed of a styrene copolymer dissolved in a vegetable oil, the thickener being present in an amount sufficient to provide the lubricant composition with a viscosity at 40° C. of greater than about 100 cSt.

2. The composition of claim 1 wherein the vegetable oil is rapeseed or canola oil.

3. The composition of claim 2 wherein the base oil has a viscosity at 40° C. in the range of about 2 to about 50 cSt.

4. The composition of claim 3 wherein the thickener comprises from about 0.1 wt. % to about 30 wt. % based on the weight of base oil and thickener.

5. The composition of claim 4 wherein the base oil is a blend of synthetic esters.

6. The composition of claim 4 wherein the base oil is an ester of a monohydroxy alcohol and a polycarboxylic acid.

7. The composition of claim 6 wherein the base oil is diisodecyl adipate.

8. A biodegradable sawguide lubricant composition comprising:

a base oil having a viscosity at 40° C. of from about 2 to about 50 cSt and composed of at least one synthetic ester;

a thickener composed of a styrene-olefin copolymer dissolved in rapeseed or canola oil, the copolymer having a number average molecular weight of about 50,000 to about 500,000, wherein the copolymer comprises 10 to 90 wt. % of the thickener, the thickener being present in the lubricant composition in an amount sufficient to provide a lubricant composition having a viscosity at 40° C. of about 110 to about 130 cSt.

9. The composition of claim 8 including from about 1 to about 5 wt. % based on the total weight of the composition of antiwear, extreme pressure and rust inhibitors; and from about 0.1 to about 2 wt. % based on the total weight of the composition's of an emulsifier.

* * * * *